United States Patent [19]

Yecheskel et al.

[11] Patent Number: 4,989,297

[45] Date of Patent: Feb. 5, 1991

[54] TREATMENT OF COTTON

[75] Inventors: Herzel B. Yecheskel, Bat Yam; Gan Alon, Herzlia; Eliezer Beck, Rishon Lezion, all of Israel

[73] Assignee: Shenkar College of Textile Technology and Fashion, Ramat Gan, Israel

[21] Appl. No.: 207,252

[22] Filed: Jun. 15, 1988

Related U.S. Application Data

[60] Division of Ser. No. 132,790, Dec. 10, 1987, Pat. No. 4,888,856, and a continuation of Ser. No. 833,987, Feb. 26, 1986, Pat. No. 4,796,334.

[30] Foreign Application Priority Data

Feb. 28, 1985 [IL] Israel ..... 74469

[51] Int. Cl.[5] ..... D01B 1/48; D01B 3/04

[52] U.S. Cl. ..... 19/27; 19/66 CC

[58] Field of Search ..... 19/0.27; 28/253; 26/6

[56] References Cited

U.S. PATENT DOCUMENTS

| | | | |
|---|---|---|---|
| 2,978,783 | 4/1961 | Clendening | 26/6 |
| 3,129,485 | 4/1964 | Shattack | 28/253 X |
| 4,535,510 | 8/1985 | Shoham | 19/0.27 |

FOREIGN PATENT DOCUMENTS

| | | | |
|---|---|---|---|
| 303575 | 2/1989 | European Pat. Off. | 19/0.27 |
| 344631 | 12/1989 | European Pat. Off. | 19/0.27 |
| 344729 | 12/1989 | European Pat. Off. | 19/0.27 |
| 0624925 | 1/1936 | Fed. Rep. of Germany | 26/6 |

*Primary Examiner*—Werner H. Schroeder
*Assistant Examiner*—Michael A. Neas
*Attorney, Agent, or Firm*—Sandler, Greenblum & Bernstein

[57] ABSTRACT

The invention relates to a process for rendering harmless sticky material adhering to cotton fibers, termed "honeydew". According to the process the cotton is heated for a brief period of time to a temperature adequate to render said honeydew hard and brittle, and this without adversely affecting the cotton fibers. There are also provided means for effecting such treatment of cotton fibers in a continuous manner.

12 Claims, 6 Drawing Sheets

TREATMENT OF COTTON

CROSS REFERENCE TO RELATED APPLICATIONS

This application is a continuation application to the commonly assigned, copending United States Application Ser. No. 06/833,987, filed Feb. 26, 1986, entitled "TREATMENT OF COTTON", now U.S. Pat. No. 4,796,334; this application is also related to and a divisional of the commonly assigned, copending United States Application Ser. No. 07/132,790, filed Dec. 10, 1987, entitled "TREATMENT OF COTTON", now U.S. Pat. No. 4,888,856.

BACKGROUND OF THE INVENTION

The present invention relates to a new and improved construction of a device for processing cotton. Sticky contaminants, resulting from a variety of insects, and especially from the white fly (Bamessia), for instance, are frequently present on cotton when this is picked. Such contaminants, generally referred to as "honeydew" renders the cotton sticky, and this causes severe problems, especially during the drawing of the slivers: as these pass through the conventional pairs of rollers, the honeydew causes adhesion to these rollers, further fibers become attached and the end-result is a work stoppage and the necessity to clean the rollers. This results in a lack of uniformity of the slivers and yarns which are produced, in serious time losses and increase of production costs with a reduction of quality of the product.

Although the quantity of such honeydew quantified by the content of reducing sugars contained therein, is generally quite low (of the order of 0.1 to 1.5 percent by weight), it causes serious problems during the various steps of the processing of cotton, and especially in the spinning process. The present invention overcomes to a large extent the problem caused by such adhesive substances and renders them harmless.

The contamination of the cotton with honeydew or the like causes problems in the processing of the cotton, at its various stages.

It is clear that the process of the invention is applicable at any of the stages of the processing of the cotton, and an early stage is of course advantageous.

Serious problems are generally encountered with such contaminated cotton during the processing on the draw frame. In the spinning process of cotton, a web is formed on a carding machine. Separation of fiber tufts into individual fibers and forming the web are done on a revolving flat card, which is a particular type of carding machine. After leaving the card, the web is pulled through a funnel-shaped hole and thus there is formed a so-called card sliver. To produce a yarn, the sliver has to be attenuated, possibly combed, and finally twisted. Six to eight slivers are fed to a draw frame, and these are drawn into one, and this operation is accompanied by attenuation or drafting,

SUMMARY OF THE INVENTION

Therefore with the foregoing in mind it is a primary object of the present invention to provide a new and improved device for processing cotton and which device permits at least partially eliminating the problems which are caused by the presence of sticky materials like honeydew and the like at the cotton.

Another and more specific object of the present invention is directed to providing a new and improved construction of a device for processing cotton and which device permits at least partially removing sticky materials such as honeydew and the like from the cotton.

A further significant object of the present invention is directed to a new and improved construction of a device for processing cotton and which device permits at least partially removing sticky materials such as honeydew and the like and can be readily integrated into existing installations for processing cotton.

Another, still important object of the present invention relates to a new and improved construction of a device for processing cotton and which device permits at least partially removing sticky materials such as honeydew and the like and is capable of being integrated at an early stage into existing installations for processing cotton.

Still another significant object of the present invention is directed to the provision of a new and improved construction of a device for processing cotton and which device permits at least partially removing sticky materials such as honeydew and the like and can be operated in a continuous manner.

Yet a further significant object of the present invention aims at providing a new and improved construction of a device for processing cotton and which permits at least partially removing sticky materials such as honeydew and the like and operates in a relatively simple and extremely economical manner, is highly reliable, not readily subject to breakdown or malfunction and requires a minimum of maintenance and servicing operations.

Now in order to implement these and still further objects of the invention, which will become more readily apparent as the description proceeds, the device of the present development is manifested, among other things, by the features that, cotton is exposed to a heat source having a predetermined temperature and is heated to a preselected maximum temperature during exposure to such heat source. The cotton is exposed to the heat source for a predetermined period of time sufficient for transforming sticky material such as honeydew and the like which is adhered to the cotton, to a hard and brittle, readily removeable material.

It is known that during laboratory tests when cotton containing honeydew is heated in a stationary manner during about 2 hours at 130° C., such cotton becomes colored yellow to yellowish-brown, as this becomes discolored by caramelized honeydew.

it has now been discovered that by subjecting cotton to a controlled heating process with a maximum of about 140° C. during a controlled period of time with a maximum of 10 seconds, and advantageously up to about 5 seconds with cotton slivers, such droplets can be rendered brittle and hard losing their adhesive properties without adversely affecting the cotton quality. The heating may be effected at any step of the process, but preferably before the drawing of the cotton slivers on the draw frame, as at this stage the most serious problems occur.

There are provided simple devices, e.g. comprising a number of rotary rollers, the surface temperature of which is maintained at a predetermined value, means being provided for passing the cotton sliver over such heated rollers so as to maintain contact for an adequate period of time to convert the sticky material to hard and brittle particles.

The heating device can be provided at any stage of an installation for processing cotton fibers. It has been found that when the cotton is heated so as to reach a temperature of about 70° to 140° C., and maintained at such temperature for an adequate period of time, adhering honeydew droplets are converted to hard and brittle particles. The overall heating time of the cotton is about ½ to about 5 seconds for slivers and up to 10 seconds for cotton bales (upper surface), and such heating substantially reduces the stickiness of the fibers or eliminates it altogether.

BRIEF DESCRIPTION OF THE DRAWINGS

In the enclosed schematical drawings, which are not according to scale.

DETAILED DESCRIPTION OF THE PREFERRED EMBODIMENTS

Describing now the drawings, it is to be understood that only enough of the construction of a cotton processing device has been shown as needed for those skilled in the art to readily understand the method of treating cotton and the underlying principals and concepts of the present development, while simplifying the showing of the drawings. Turning attention now specifically to FIG. 1 of the drawings, the device illustrated therein by way of example and not limitation will be seen to comprise a device for processing cotton, and containing, for example, the conventional draw frame 17.

Figure 1:
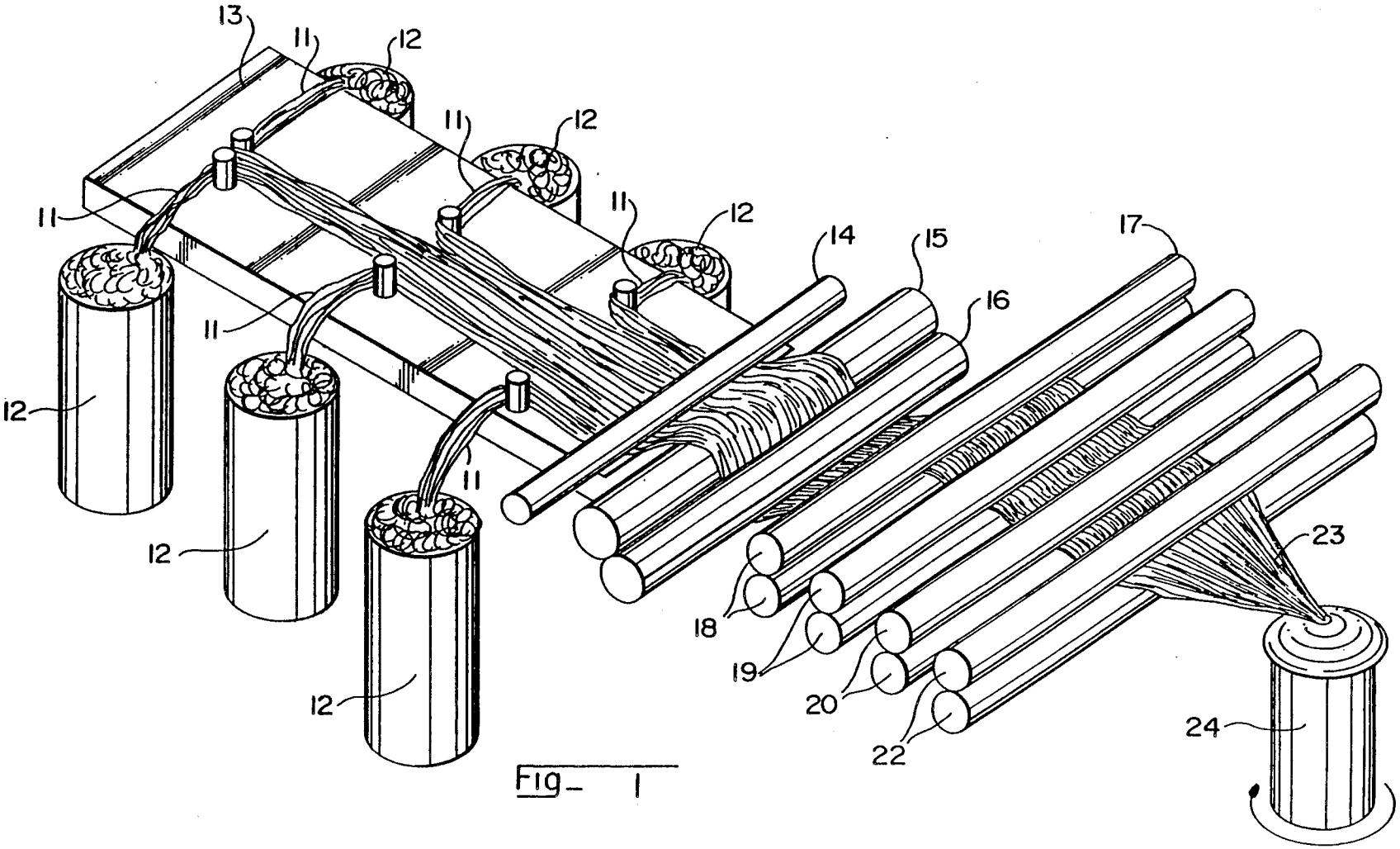
FIG. 1 is a perspective view of a first exemplary embodiment of the device of the invention in combination with a conventional drawing frame.

As shown in FIG. 1 cotton slivers 11 are drawn from the six cans 12 and over flat surface 13 under roller 14, and through the rotatory rollers 15 and 16, and from these to the conventional draw frame 17 which comprises 4 roller pairs 18, 19, 20 and 22, from which the resulting sliver 23 is drawn into the container 24.

The rollers 15 and 16 are provided with internal electrical heating means which are provided with heat control means, so that the surface temperature of the rollers 15 and 16 can be adjusted to any predetermined value. Various experiments have shown that generally surface temperatures of from about 150° C. and to about 230° C. are satisfactory. The cotton slivers 11 are pressed over the said rollers 15 and 16 at a speed of about 30 m/min (or 50 cm/sec). The cotton slivers 11 tested were 4 g/m sticky cotton, contaminated with considerable quantities of honeydew. The contact length of the cotton slivers 11 with the rollers was a total of about 55 cm and the cotton sliver was heated during this period of time in such manner that it reached a temperature of about 75° C. The heating to this temperature for the contact time indicated, was adequate to render the adhesive droplets hard and brittle. When the conventional device was used without this attachment, the cotton slivers stuck to the roller pairs and caused serious problems. When the rollers are heated to a higher temperature, the time of contact can be decreased.

Figure 3:
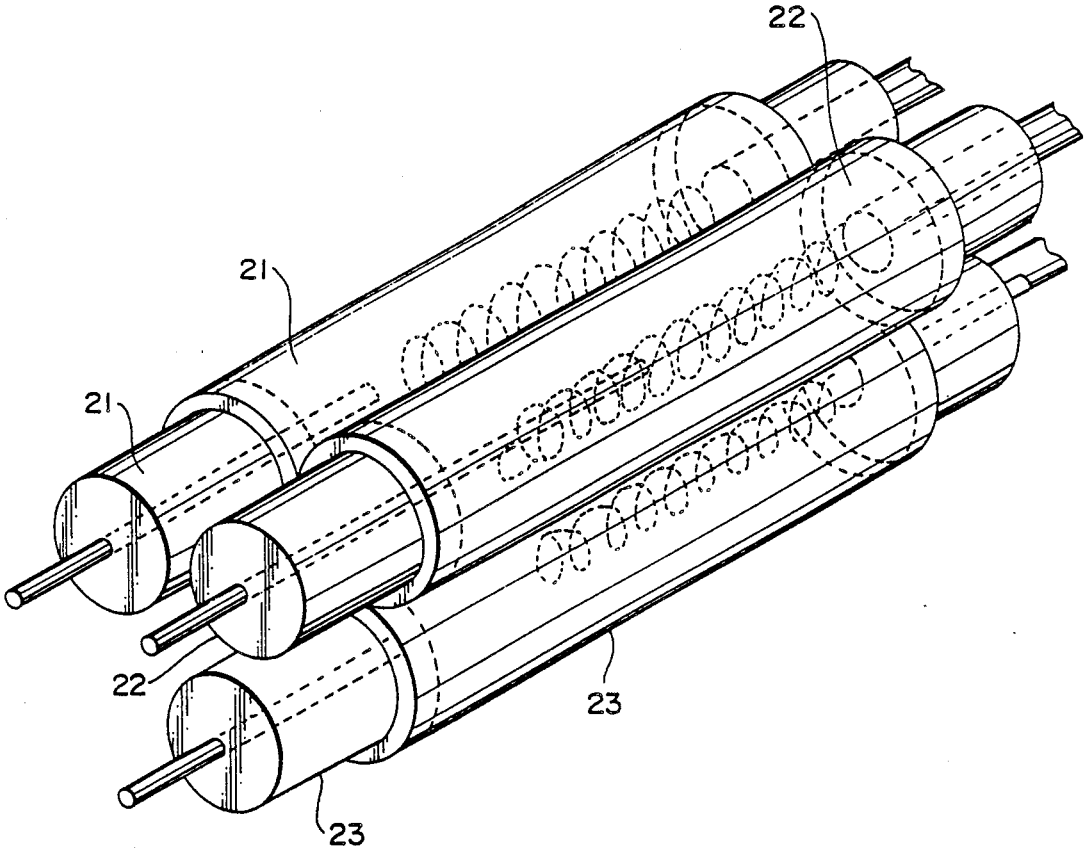
FIG. 3 is a perspective view of three rollers and shows details of the heating means.

Details of a three-roller system for use with, for example, the drawing frame 17 is shown in FIG. 3. The rollers 21, 22 and 23 are provided with internal electrical heating coils and with electrical leads for connection with a power source. Heating of the electrical resistance elements results in a predetermined surface temperature of the rollers 21, 22 and 23 and such temperature may be automatically maintained within a narrow range by means of a thermostat.

Figure 2:
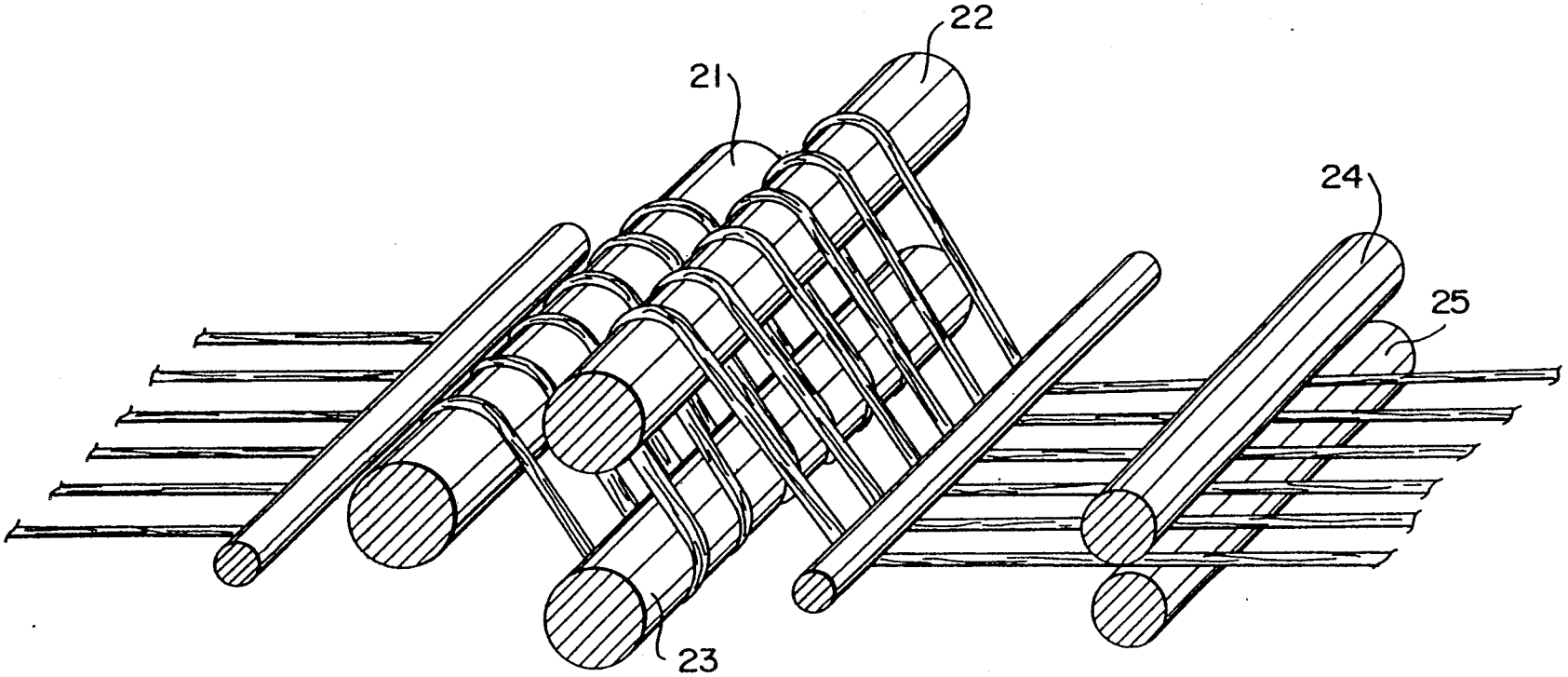
FIG. 2 is a perspective side-view of part of such device with three heated rollers.
Figure 4:
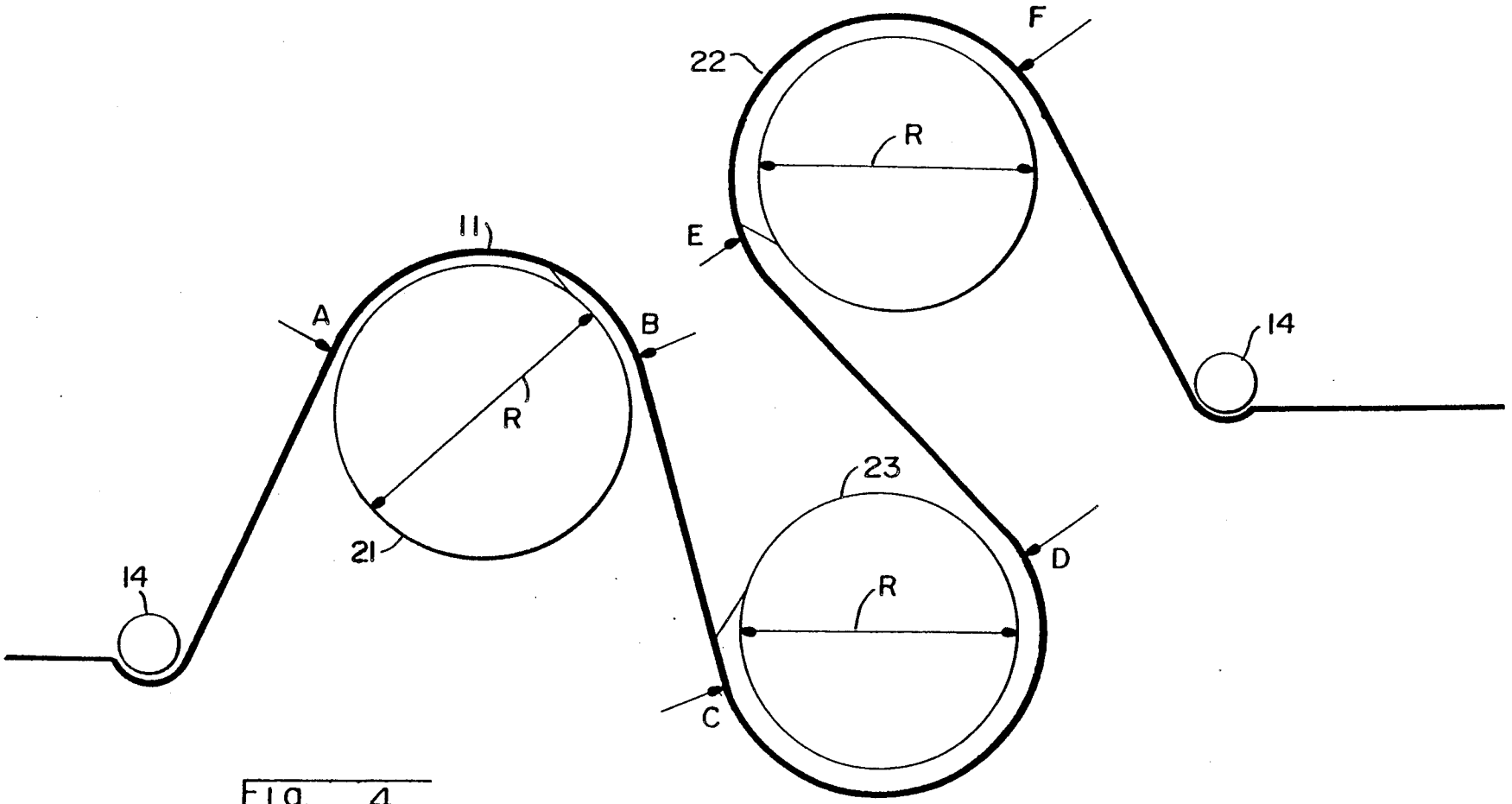
FIG. 4 illustrates constructional details of the roller system shown in FIG. 2.

FIG. 2 illustrates such a device provided with the three electrically heated rollers 21, 22 and 23, from which the slivers move to the draw frame, the first pair of rollers of which, 24 and 25, are shown. The dimensions of the rollers 21, 22 and 23, and the configuration of these are shown in detail in FIG. 4. The rollers 21, 22, and 23 have each a diameter of 85 mm and the distance between the surfaces of these rollers is 30 mm. The total length of contact from the points A to B, plus C to D, plus E to F, of the cotton sliver 11 moving in the direction M about the three rollers of the device of the invention, is about 55 cm. Heating of the cotton sliver 11 to a minimum temperature of 70° C. at a velocity of 30 m/min renders the adhering honeydew droplets brittle and hard. When the cotton sliver 11 is moved at a higher velocity there must be used a higher surface temperature and/or a longer path of contact with the heated surfaces. The further processing of the cotton slivers does not cause any problems. The hard droplets are subsequently crushed to powder or to small particles, and can be sucked off. No adverse effect was observed as regards cotton quality or color. It is generally advisable to allow the cotton to attain equilibrium with ambient humidity before further processing.

It should be clear that the rollers may be heated with hot air, hot liquid and that any combination of heat conduction, convection and radiation may be used in the heating process.

Figure 5:
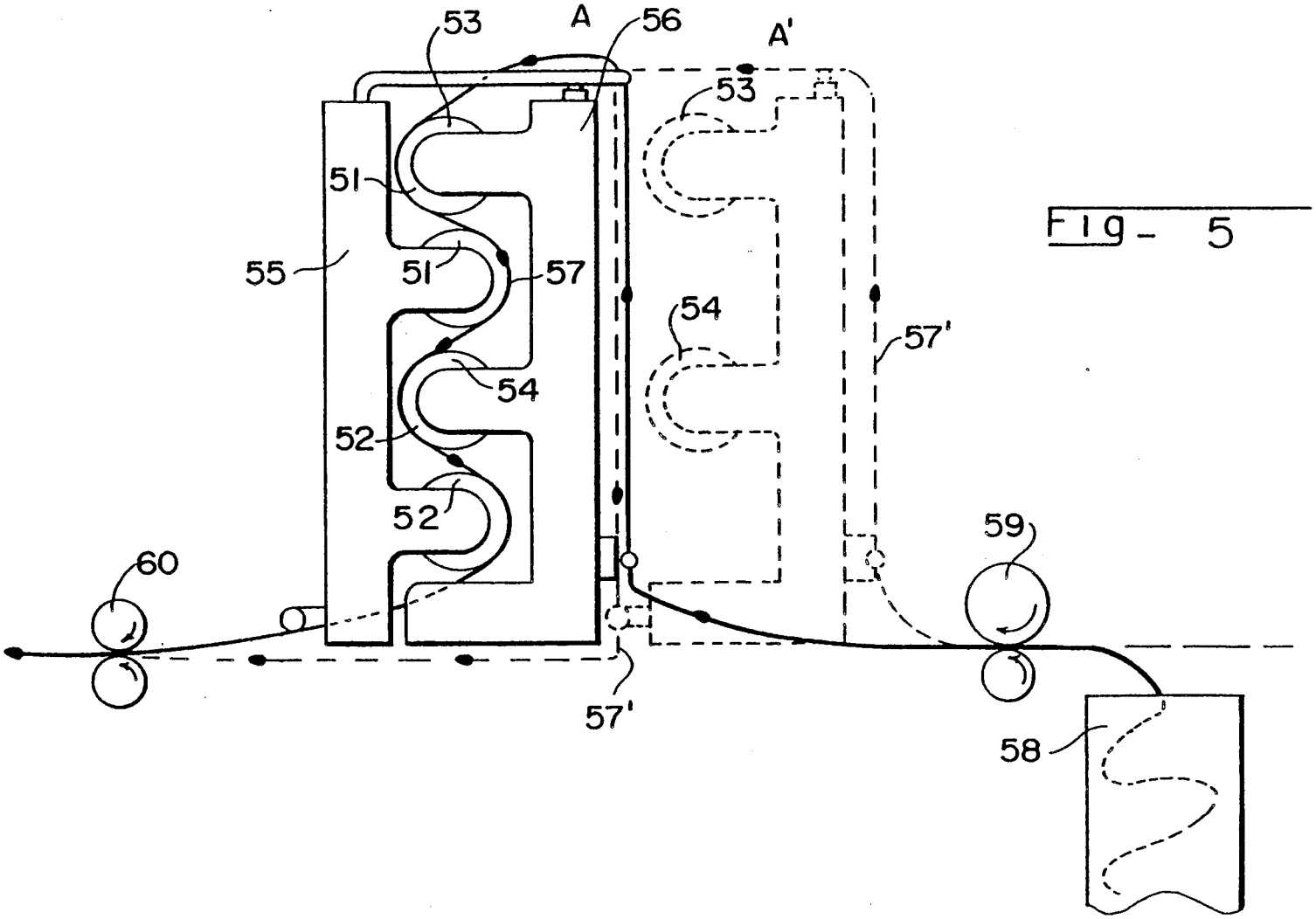
FIG. 5 is an elevational sectional view through a further exemplary embodiment of a heating device according to the invention for processing cotton fiber sliver.

As shown in FIG. 5, there is provided a system comprising four heated rollers 51, 52, 53 and 54, each of which is provided with a heating element (not shown) which maintains during operation a predetermined and preselected surface temperature.

As shown, the system comprises a support frame 55 on which there are mounted the heated rollers 51 and 52, whereas the rollers 51 and 54 are mounted on a movable frame 56.

When frame 56 is in the A position, the cotton sliver 57, from container 58, passes essentially in contact with half the circumference of each of the rollers 51 to 54, as shown in the figures, and through roller pairs 59 and 60, which are synchronized with the other rollers. In this position, the cotton sliver 57 takes the configuration shown by the full line. When for any reason the process is to be interrupted, in order to prevent overheating, frame 56 is moved towards the right, reaching the position indicated in dashed lines, A', with the cotton sliver 57' in the dashed configuration in which this cotton sliver 57' is out of contact with any heated surface. This movement can automatically be actuated whenever the process is to be temporarily interrupted. When treatment of the cotton sliver 57 is to be resumed, the device is actuated, the right-hand-side rollers 53 and 54 move again to the position adjacent to the left-hand ones, which takes a few seconds. Only after the rollers 53 and 54 have again reached the original position, is the movement of the cotton sliver 57 actuated. It is of course possible to use any number of heated rollers, from 3 upwards, with at least one being on the right-hand side frame.

Figure 6:
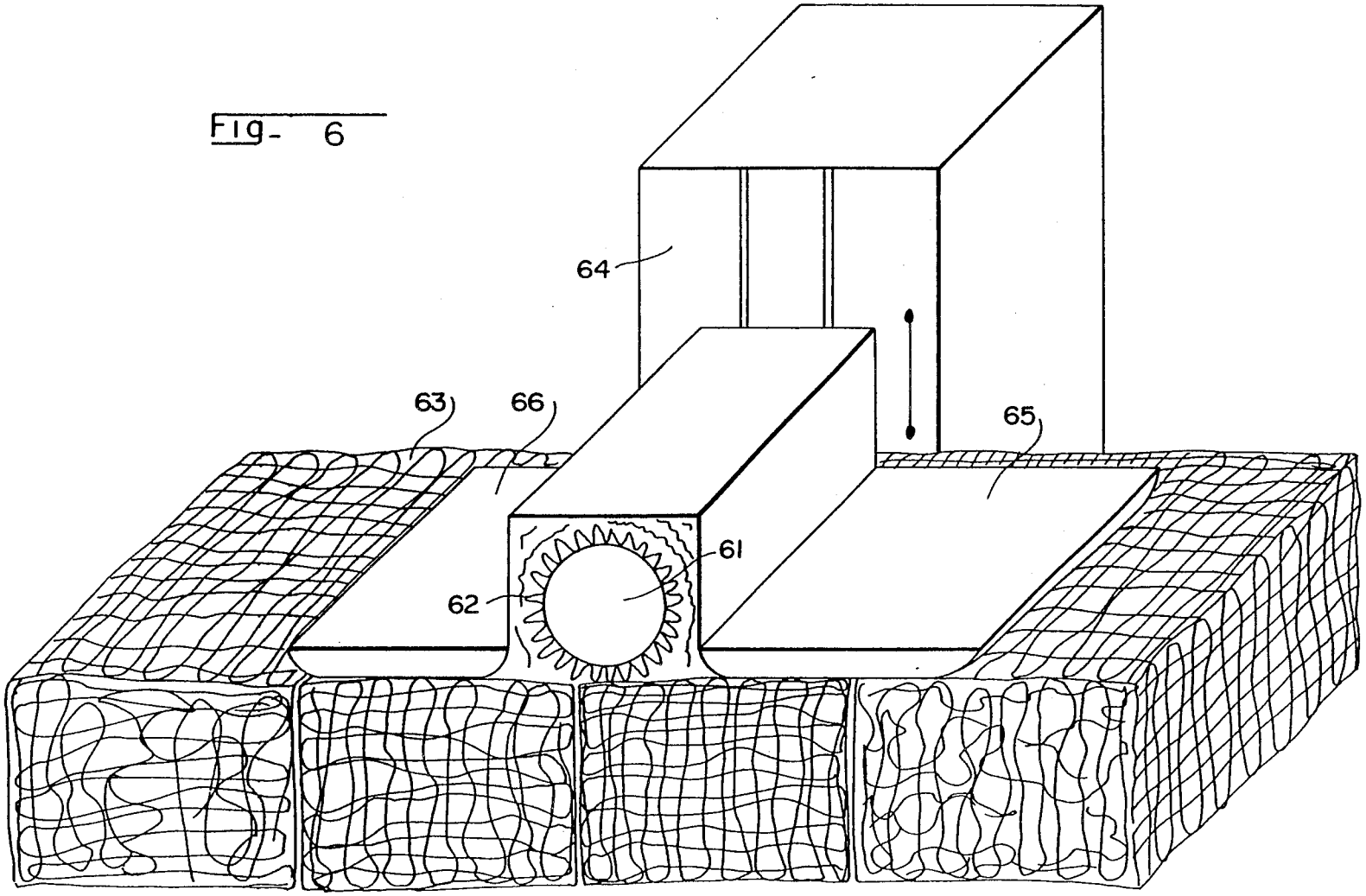
FIG. 6 is a perspective side-view of another exemplary embodiment of the inventive device for processing cotton bale.

The surface temperature does not differ from that set out in the other embodiments, and also the period of time during which the cotton sliver is in touch with the heated rollers. A further embodiment of the invention is illustrated with reference to FIG. 6. Raw cotton is supplied in the form of bales 63, and flock or tufts 62, detaching machines are used in order to gradually remove the cotton in the form of tufts which are removed by a moving device. The tufts are removed by means of a wheel 61 in a plurality of passes over the bales 63 which are arranged in line, and thus there is also comprised a homogeneous blend of a plurality of bales, resulting in a uniform product. The thickness of the cotton layer which is removed in each pass can be preselected within a rather wide range. The tufts are sucked by a vacuum system (not shown) into a further stage of processing.

The wheel 61 is provided with a plurality of teeth or other structures for plucking the tufts 62 and which rotate so as to remove the tufts of cotton as the device passes over the bales of cotton 63, the tufts being sucked by means of the vacuum system into section 64. According to the invention there are provided heating devices 65 and 66, with heating means adapted to maintain the surface of the plates in contact with the cotton at a predetermined and preselected temperature as the device moves over said bales. When the device moves from left to right, the heating device 65 is heated, when the movement is in the opposite direction, heating device is heated. The contact of the heated plates with the upper layer of the cotton is such that it renders the honeydew particles (droplets) brittle and hard. Such attachment may be used in addition to said heated-roller devices of the invention, or it may be used, to a large extent, instead of the roller devices. According to a preferred embodiment, both plates 65 and 66 are heated.

It should be clear that the device of the invention can be installed before the blending of the slivers to a single sliver on the draw frame. The device, in fact, can be installed at any preceding stage of the cotton processing installation.

It should be clear that the heating, after ginning, at the gin or at the spinning mill, to a temperature of above 70° C. can be effected by various means such as hot air, IR heating or the like, as set out above. The invention is intended to encompass any means adequate to heat-treat cotton fibers before or during processing at the spinning mill. This treatment results in rendering of the adhesive sticky honeydew droplets hard and brittle. The devices for heating the upper surfaces of cotton bales can also be provided as separate entities, to be used in conjunction with flock-detaching machines. The hard and brittle droplets are generally crushed to small particles or powder as the slivers pass through the draw frames, or they can be passed through a pair of crushing rollers. Such particles and powder is advantageously removed by a vacuum suction system.

While there are also shown and described present preferred embodiments of the invention, it is to be distinctly understood that the invention is not limited thereto, but may be otherwise variously embodied and practiced within the scope of the following claims.

Accordingly, we claim:

1. A device for processing cotton containing cotton fibers, comprising:

a heat source having a predeterminate temperature;

means for exposing the cotton to said heat source having said predeterminate temperature, for heating the cotton to a preselected maximum temperature;

said means for exposing the cotton to said heat source having said predeterminate temperature, heating the cotton to said preselected maximum temperature within a predetermined period of time sufficient for transforming honeydew, which is adhered to the cotton, to a hard and brittle, readily removable material; and said means for exposing the cotton to said heat source compressing the cotton fibers of the cotton to enhance heat transfer to the honeydew.

2. The device as defined in claim 1, wherein:

said exposing means heats the cotton to a preselected maximum temperature of up to 140° C.

3. The device as defined in claim 2, wherein:

said exposing means heats the cotton to a preselected maximum temperature in the range of 70° C. to 100° C.

4. The device as defined in claim 1, wherein:

said means for exposing the cotton to said preselected maximum temperature for said predetermined period of time, exposing the cotton to said heat source having said predeterminate temperature, for an increasing predetermined period of time with an increase in the preselected maximum temperature to which the cotton is heated.

5. The device as defined in claim 4, wherein:

said means for exposing the cotton to said heat source for heating the cotton to said preselected maximum temperature for said predetermined period of time, exposing the cotton for an increasing period of time in the range of about half a second to about 10 seconds for an increase in said preselected maximum temperature from 70° C. to 140° C.

6. The device as defined in claim 1, wherein:

said means for exposing the cotton to said heat source for heating the cotton to said preselected maximum temperature for said predeterminate period of time heating the cotton to said predeterminate maximum temperature for a period of time with is sufficient for producing discoloration of the cotton to which said honeydew is adhered.

7. A device for processing cotton, comprising:

a heat source having a predeterminate temperature;

means for exposing the cotton to said heat source having said predeterminate temperature, for heating the cotton to a preselected maximum temperature;

said means for exposing the cotton to said heat source for heating the cotton to said preselected maximum temperature, exposing the cotton to said heat source for a predetermined period of time sufficient for heating the cotton to the preselected maximum temperature and thereby transforming honeydew, which is adhered to the cotton, to a hard and brittle, readily removable material;

said heat source containing at least one rotatable and heatable roller;

said at least one rotatable and heatable roller possessing at least one circumferential roller surface constituting said means for exposing the cotton to said heat source;

said at least one circumferential roller surface being heatable by said at least one rotatable and heatable roller to said predeterminate temperature; and means for moving the cotton relative to and in contact with the at least one circumferential roller surface of said at least one rotatable and heatable roller within said predetermined period of time sufficient for heating the cotton to said preselected maximum temperature and transforming said honeydew, which is adhered to the cotton, to said hard and brittle, readily removable material.

8. The device as defined in claim 7, wherein:

said at least one rotatable and heatable roller contains internal heating means.

9. The device as defined in claim 8 wherein:

said internal heating means contain means for throughpassing a heated heat carrier fluid through said at least one rotatable and heatable roller.

10. The device as defined in claim 7, further including:

removing means for removing the hard and brittle material formed from said honeydew, which is adhered to the cotton;

said removal means containing at least one pair of rollers between which the hard and brittle material is crushed by passing therethrough the heat-treated cotton.

11. The device as defined in claim 10, wherein:

said at least one pair of rollers constitutes a drawing frame.

12. The device as defined in claim 11, wherein:

said at least one circumferential roller surface of said at least one rotatable and heatable roller are heated by said at least one rotatable and heatable roller and said means for moving the cotton relative to and in contact with the at least one circumferential roller surface moving the cotton relative to and in contact with said at least one circumferential roller surface such that the cotton is heated to a preselected maximum temperature in the range of 70° to 140° C. within in a predetermined period of time increasing in the range of from about half a second to about ten seconds with an increase in said preselected maximum temperature in the range of from 70° C. to about 140° C.

* * * * *

Disclaimer 4,989,297.—*Herzel B. Yecheskel*, Bat Yam; *Gan Alon*, Herzlia; *Eliezer Beck*, Rishon Lezion, all of Israel. TREATMENT OF COTTON. Patent dated Feb. 5, 1991. Disclaimer filed Feb. 6, 1991, by the assignee, Shenkar College of Textile Technology and Fashion.

The term of this patent subsequent to Jan. 10, 2006, hgas been disclaimed.

[ *Official Gazette May 14, 1991* ]